United States Patent [19]

Soulakis

[11] Patent Number: 4,535,705

[45] Date of Patent: Aug. 20, 1985

[54] SYSTEMS IN WHICH ONE OR MORE OBJECTS ARE SUPPORTED BY VERTICAL STANDARDS

[75] Inventor: George Soulakis, Hermosa Beach, Calif.

[73] Assignee: Eldon Industries, Inc., Inglewood, Calif.

[21] Appl. No.: 522,405

[22] Filed: Aug. 11, 1983

[51] Int. Cl.[3] ..... A47B 5/00

[52] U.S. Cl. ..... 108/152; 108/107; 248/245

[58] Field of Search ..... 248/245, 243; 16/DIG. 6, 82; 49/415; 108/107, 152

[56] References Cited

U.S. PATENT DOCUMENTS

| | | | |
|---|---|---|---|
| 918,625 | 4/1909 | Wilkinson | 16/DIG. 6 |
| 1,077,193 | 10/1913 | Edwards | 49/415 |
| 2,901,205 | 8/1959 | Gredell | 248/245 |
| 3,306,466 | 2/1967 | Liston | 108/107 |
| 3,848,844 | 11/1974 | Barrett | 248/245 |
| 4,030,612 | 6/1977 | Gray | 108/107 |
| 4,212,445 | 7/1980 | Hagen | 248/245 |

*Primary Examiner*—James T. McCall
*Attorney, Agent, or Firm*—Edward D. O'Brian; K. H. Boswell

[57] ABSTRACT

Many different so-called "wall systems" as are often used in offices and other locations employ perforate, vertically extending, spaced, parallel standards in supporting one or more objects through the use of hooks extending through perforations in the standards. Any such system can be improved by utilizing sloping surfaces on an object held by the standards and a wedging member associated with each sloped surface. When an object with such a surface is in place on a standard so that the hooks employed extend through openings in the standard the wedging member associated with the surface is moved so as to be wedged between the sloped surface with which it is associated and the standard so as to move the object generally outwardly from the standard in order to pull the hooks firmly in contact with the interior of the standard. This results in the object being held firmly relative to the standard employed.

7 Claims, 4 Drawing Figures

SYSTEMS IN WHICH ONE OR MORE OBJECTS ARE SUPPORTED BY VERTICAL STANDARDS

BACKGROUND

This invention pertains to new and improved systems in which one or more objects are supported by vertically extending standards. More specifically it pertains to systems which differ from prior related systems primarily in that any object held by the standards is held firmly in such a manner that it will not move.

The systems of the present invention are very closely related to many prior so-called "wall systems" which are constructed so as to utilize two or more vertically extending, spaced, parallel standards having perforate surfaces facing the same direction and utilizing hooks on each object supported by these standards to secure it to the standards utilized. The standards used in these prior systems are normal in hollow metal structural members which are either formed integrally with various different types of walls or partitions so as to serve a structural function in connection with such walls or partitions or which are mounted on existing walls or partitions solely for the purpose of mounting various objects on the latter.

Normally these standards are constructed so as to have a series of equally spaced, aligned, vertically extending rectangular slots extending along their lengths in the normally exposed surfaces of these standards. They may utilize circular or eliptical holes instead of such slots for the purpose of receiving the hooks on various objects used with this type of a structure. The hooks are, of course, normally dimensioned so as to fit through the openings or perforations used in such a manner as to engage the interiors of the standards so as to block or prevent movement of an object.

Although wall systems as briefly described in the preceding are highly desirable and highly utilitarian in character, a problem has been encountered in mounting various types of items or objects on the standards employed in them. This problem concerns the development of an adequate holding action between the hooks used on various objects and the standards which effectively preclude minor movements between an object and a wall as, for example, when an object is engaged by the hand and is manipulated in one manner or another. At times a "firm" positioning of an object held by wall standards is desirable in preventing sagging of the object relative to the standards used with it or in minimizing the effects of vibration.

BRIEF SUMMARY OF THE INVENTION

As a result of these considerations it is considered that there is a need for new and improved systems in which objects are supported by vertically extending standards. More specifically it is considered that there is a need for improved wall systems of a type as indicated in the preceding which differ from prior wall systems in that they are constructed so as to effectively preclude relative movement between the standards employed in such systems and any object supported by such standards.

It is also considered that there is a need for new and improved wall systems as described which may be easily and conveniently manufactured at a comparatively nominal cost, and which may be easily and conveniently manipulated in assembling and disassembling such systems. It is further considered that there is a need for wall systems in this type of structure which may be utilized over long periods without any maintenance or adjustment. The invention is also intended to provide wall systems which utilize existing standards.

In accordance with this invention these and various related objectives are achieved by providing a system in which an object is held by two spaced, parallel, vertically extending standards having perforate surfaces facing the same direction and hollow interiors adjacent to said perforate surfaces through the use of hooks on said object extending through perforations in both of said surfaces and engaging the interiors of said standards, in which the improvement comprises: a sloped surface on said object adjacent to one of said standards, a wedging member associated with said sloped surface, said wedging member being capable of being moved relative to its associated sloped surface so as to be wedged between its associated sloped surface and the adjacent standard so as to move said object outward from said standard in order to pull said hooks firmly in contact with the interior of said standard.

BRIEF DESCRIPTION OF THE DRAWING

Because of the nature of this invention is it best more fully described in connection with the accompanying drawing in which.

Figure 1:
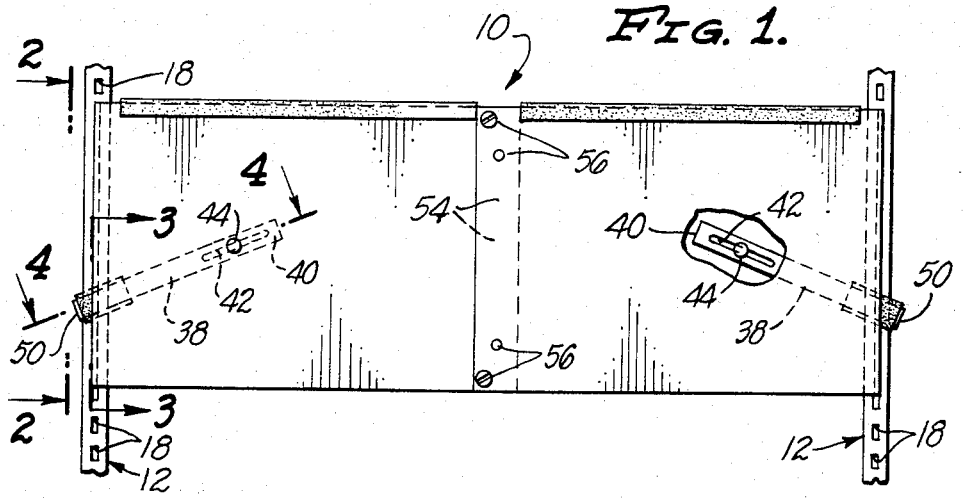
FIG. 1 is a front elevational view of a presently preferred embodiment or form of the system in accordance with this invention.
Figure 2:
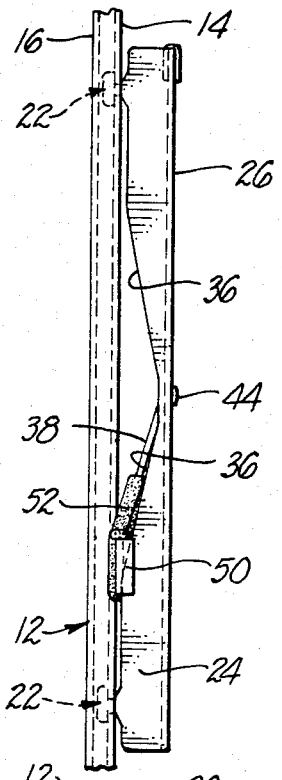
FIG. 2 is a partial, side elevational view taken at line 2—2 of FIG. 1 at an enlarged scale.
Figure 3:
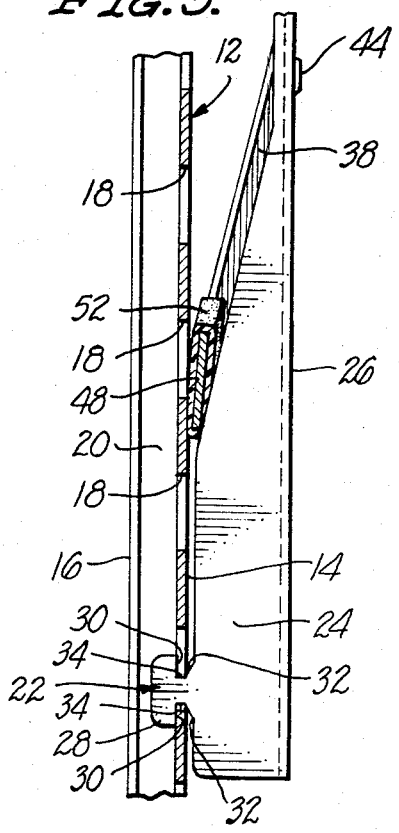
FIG. 3 is a partial, cross-sectional view taken at line 3—3 of FIG. 1 at a further enlarged scale.
Figure 4:
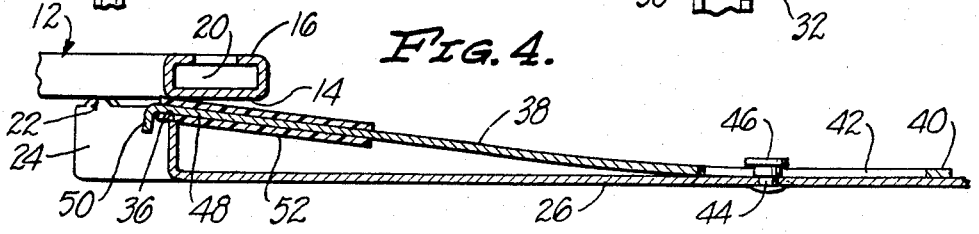
FIG. 4 is a partial, cross-sectional view taken at line 4—4 of FIG. 1 at the enlarged scale used in connection with FIG. 2.

The particular system illustrated in the drawing is designed and constructed so as to utilize the operative concepts or principles of the invention set forth and defined in the appended claims forming a part of this disclosure. These concepts and principles can easily be utilized in other differently appearing and somewhat differently constructed systems through the use or exercise of routine mechanical engineering skill of the type commonly employed in the design construction of office partitions and common items of office equipment.

DETAILED DESCRIPTION

In the drawing there is shown a "system" 10 in accordance with this invention which utilizes two conventional, identical, spaced, parallel, vertically extending, metal standards 12. These standards 12 are of a rectilinear cross-sectional configuration and include parallel front and back surfaces 14 and 16 respectively. The back surfaces 16 may be mounted upon a conventional wall or partition (not shown) or, if desired, the standards 12 can be incorporated within a wall or partition (not shown) so that only the front surfaces 14 are visible and exposed. In the alternative it is possible to merely support the standards 12 at their upper and/or lower ends (not shown) in any convenient manner so that they extend vertically or nearly vertically.

The front surfaces 14 of the standards 12 are provided with rectilinear, elongated openings 18 leading through the surfaces 14 into the interiors 20 of these standards 12. These openings 18 are aligned in each of the standards 12 and, of course, are spaced from one another at uniform consistent distances. Further, these openings 18 are preferably located on the standards 12 so that each opening 18 on one of the standards 12 is at exactly the same height as a corresponding opening 18 in the other of the standards 12.

These openings 18 are for the purpose of receiving and holding identical hook elements 22 on identical end flanges 24 of an elongated panel or similar object 26. The hook elements 22 on the end flange 24, in effect, constitute extensions of the end flanges 24 upon which they are located and are of the same thickness as the end flanges 24 upon which they are located. Preferably these hook elements 22 are of slightly less thickness than the widths of the openings 18 so as to be capable of being slid into position within these openings 18 with minimal difficulty.

Each of the hook elements 22 includes an enlarged head 28 and a notch 30 having a sloping side wall 32 leading to a flat bottom wall 34. The total widths of the notches 30 are greater than the thickness of a standard 12 adjacent to an opening 18. This provides for easy insertion of the hook elements 22. The sloping side walls 34 sort of automatically guide the hook element 22 so that they fit against the bottom walls 34. Since the bottom walls 34 are preferably of a width corresponding to the thickness of the standard 12 adjacent to the openings 18 this structure provides for reasonable stability of the panel 26 when the panel 26 is "hooked" onto the standards 12.

Although there is this stability it is normally not sufficient to hold the panel 26 against minor sagging and minor degrees of movement as the panel 26 or something attached to it is manipulated or engaged by the hand or as the entire "system" 10 is subject to vibration. The present invention serves to remedy this problem by forming on the end flanges 24 sloped surfaces 36. These are utilized in conjunction with elongated, lever-like wedging members 38.

These wedging members 38 are elongated, somewhat resilient metal strips. They are provided with ends 40 containing elongated slots 42. Pins 44 are provided on the panel 26 for the purpose of holding these ends 40 so as to permit a degree of rotation of the wedge members 38 relative to the panel 26 and for securing the ends 40 to this panel 26 so that the length of a member 38 which can be pivoted can be changed slightly by sliding a wedge member 38 relative to its associated pin 44. These wedge members 38 are held in place by heads 46 on the pins 44 securing the ends 40 against movement generally away from the panel 26.

The wedge members 38 also include other ends 48 having small turned up flange like projections 50 which are adapted to engage during the manipulation of these wedge members 38. Preferably, but not necessarily, protective plastic sleeves 52 designed to prevent metal scraping against metal are located on the ends 48 adjacent to the projections 50.

These wedge members 38 are designed in this manner so that the distance between the projections 50 and the corresponding pins 48 may be varied as the wedge members 38 are pivoted from a horizontal position relative to the panel 26 in such a manner that these sleeves 52 (and the members 38) are moved generally between the sloped surfaces 36 and the front surfaces 14. Such motion has the effect of wedging or camming the panel 26 outwardly away from the standards 12. With a comparatively moderate amount of force these wedge members 38 will, in effect, wedge the panel 26 outwardly from the standards 12 to the sufficient extent that the entire panel 26 is held against virtually any relative movement between it and the standards 12. After the panel 26 has been secured in this manner it can, of course, be released by pushing on the projections 50 so as to rotate the wedge members 38 back to a substantially horizontal position.

It is believed that it is quite obvious that many different changes may be made in the "system" 10 illustrated. The particular "system" 10 shown is essentially of a bilaterally symmetrical character in that the panel 26 is constructed so as to include hook elements 22 and end flanges 24 which can be employed either in the orientation illustrated or in a reverse, upside down orientation. This is considered desirable in minimizing assembly difficulty. It is noted that in either orientation of a panel 26 as discussed the wedge members 38 can be moved to a downward position to "lock up" the panel 26 against undesired movement. This is considered desirable in avoiding any possibility of a wedge member being either located so that it could fall to a downward, nonbinding position as the "system" 10 is used.

No effort has been made in this discussion to indicate the utility of a particular panel 26. Such a panel may in and of itself, be utilized as a bulletin or display board. It can also be utilized to hold or support a wide variety of different items of office equipment or the like. If desired, it can include overlapping edges 54 held together by conventional fasteners 56 so that the distances between the flanges 24 may be adjusted in case this should be necessary or desirable as, for example, when the standards 12 are some different distances apart in different installations. These standards 12 may not be of exactly the variety illustrated. Any conventional standard reasonably corresponding to the standards 12 may be utilized in a "system" 10 in accordance with this invention.

I claim:

1. A system in which an object is held by two spaced, parallel, vertically extending standards having perforate surfaces facing the same direction and hollow interiors adjacent to said perforate surfaces through the use of hooks on said object extending through perforations in both of said surfaces and engaging the interiors of said standards, in which the improvement comprises:

a sloped surface on said object adjacent to one of said standards, a wedging member associated with said sloped surface, and mounted on said object so as to be capable of being moved relative to said object, said wedging member being capable of being moved relative to its associated sloped surface so as to be wedged between its associated sloped surface and the adjacent standard so as to move said object outward from said standard in order to pull said hook firmly in contact with the interior of said standard.

2. A system in which an object is held by two spaced, parallel, vertically extending standards having perforate surfaces facing the same direction and hollow interiors adjacent to said perforate surfaces through the use of hooks on said object extending through perforations in both of said surfaces and engaging the interiors of said standards, in which the improvement comprises:

a sloped surface on said object adjacent to one of said standards, a wedging member associated with said sloped surface, said wedging member being capable of being moved relative to its associated sloped surface so as to be wedged between its associated sloped surface and the adjacent standard so as to move said object outward from said standard in order to pull said hooks firmly in contact with the interior of said standard, and said wedging member is an elongated strip having ends, one of said ends being pivotally mounted on said object.

3. A system as claimed in claim 2 wherein:

said hooks are shaped so as to be capable of engaging said standards when said object is in an upside down orientation, there are two of said sloped surfaces on said object, either of said sloped surfaces being capable of cooperating with said wedging member in order to pull said hooks firmly in contact with the interior of said standard.

4. A system as claimed in claim 2 wherein:

said strip is an elongated resilient strip having a slotted end and, said object includes a pin means mounted thereon and extending through the slot in the end of said wedging member, said pin means securing said strip so that the length of it which can be pivoted can be changed by sliding said strip relative to said pin means and so that said strip can be rotated into engagement with said sloped surface.

5. A system as claimed in claim 2 wherein:

there are two of said sloping surfaces, one of said sloping surfaces being adjacent to one of said standards, the other of said sloping surfaces being adjacent to the other of said standards, there are two of said wedging members, each of said wedging members being associated with one end of said object.

6. A system as claimed in claim 5 wherein:

said hooks are shaped so as to be capable of engaging said standards when said object is in an upside-down orientation, there are two of said sloped surfaces adjacent to each one of said standards, one of said sloped surfaces adjacent to each of said standards being capable of cooperating with said wedging member in order to pull said hooks firmly in contact with the interior of the adjacent standard when said object is in its normal orientation, the other of said sloping surfaces being capable of cooperating with said wedging member in order to pull said hooks firmly in contact with the interior of the same standards when said object is in an upside down orientation.

7. A system as claimed in claim 6 wherein:

each of said strips is a resilient, elongated strip having a slotted end, and said object includes a pin means in association with each wedging member, each of said pin means extending through a slot in the end of one of said wedging members and enabling said wedging members to be slid with respect to said pin means and to be rotated with respect to said pin means.

* * * * *